United States Patent [19]

Tillotson

[11] Patent Number: 4,519,664

[45] Date of Patent: May 28, 1985

[54] MULTIPIN CONNECTOR AND METHOD OF REDUCING EMI BY USE THEREOF

[75] Inventor: John D. Tillotson, Southfield, Mich.

[73] Assignee: Elco Corporation, El Segundo, Calif.

[21] Appl. No.: 466,977

[22] Filed: Feb. 16, 1983

[51] Int. Cl.[3] ..... H01R 13/658

[52] U.S. Cl. ..... 339/143 R; 333/12

[58] Field of Search ..... 339/143 R, 92 M, 186 M; 333/182, 183, 81 R, 12

[56] References Cited

U.S. PATENT DOCUMENTS 4,032,213 6/1977 Snyder et al. ..... 339/186 M

*Primary Examiner*—Eugene F. Desmond

*Attorney, Agent, or Firm*—Body, Vickers & Daniels

[57] ABSTRACT

In a multipin connector to be fixedly mounted over a conductor access opening in a supporting wall of a digital device of the type operated by signals having frequency components capable of radiating electromagnetic waves about 5–30 Megahertz, which connector includes a header to be secured over the access opening, supports for fixedly supporting a plurality of conductor interconnecting pins on parallel axes passing through the access opening in a preselected pin layout pattern and the header providing for electrical isolation of the pins one-from-the other, there is an improvement. This improvement is a pin encircling member formed of a blend of finely divided particles surrounded by an electrically non-conductive material wherein the blend of particles include at least a first material having a high magnetic permeability and a low magnetic retentivity and a second electrically conductive material. This encircling member has a central bore or cavity with an inwardly facing profile generally matching the pin pattern so that the encircling member can be fixedly mounted onto the header itself. Electrical energy is concentrated and dissipated by the pin encircling member itself. The use of this improved connector reduces EMI at the connector and for the incoming or outgoing harness.

43 Claims, 12 Drawing Figures

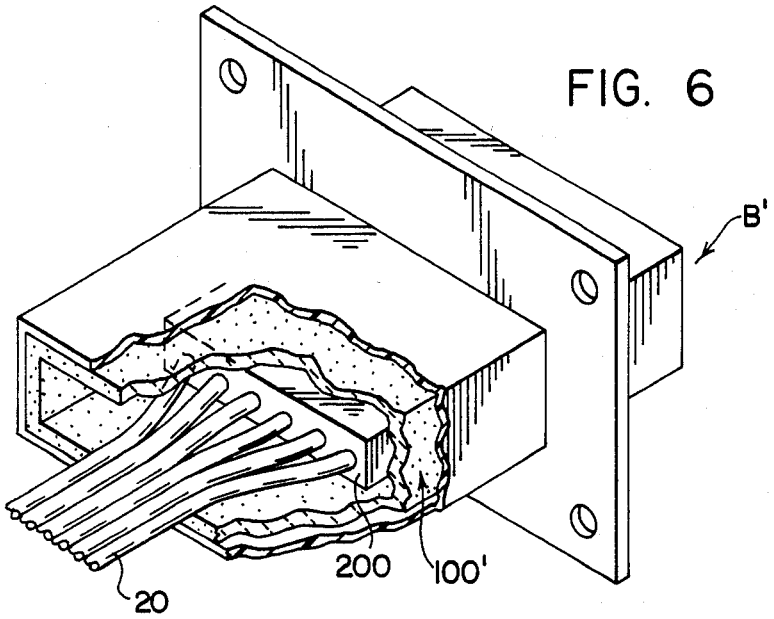
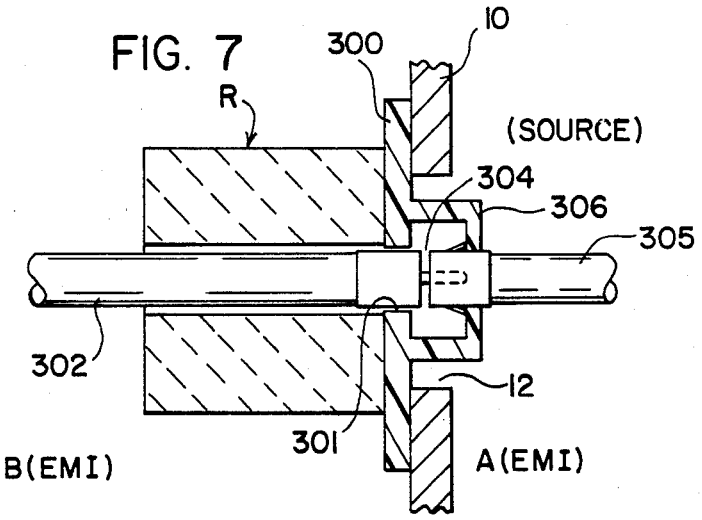
A TO B = 5 – 20dB

| POSITION | A | B | C | D | E | F | G | H | I | J | K | L |
|---|---|---|---|---|---|---|---|---|---|---|---|---|
| 6 | .250 | .255 | .750 | .755 | .785 | 1.250 | 1.00 | 1.220 | .965 | 1.00 | .255 | .315 |
| 12 | .250 | .255 | | | | 1.250 | | | .965 | 1.00 | .255 | .315 |
| 18 | .250 | .255 | | | | 1.250 | | | .965 | 1.00 | .255 | .315 |
| 24 | .250 | .255 | | | | 1.250 | | | .965 | 1.00 | .255 | .315 |

| POSITION | A | B | C | D | E | F | G | H | I | J | K | L |
|---|---|---|---|---|---|---|---|---|---|---|---|---|
| 6 | .250 | .255 | .750 | .755 | .785 | 1.035 | .936 | .960 | 1.460 | 1.470 | 1.530 | 2.030 |
| 12 | .250 | .255 | | | | | 1.872 | | | | | |
| 18 | .250 | .255 | | | | | 2.808 | | | | | |
| 24 | .250 | .255 | | | | | 3.744 | | | | | |

MULTIPIN CONNECTOR AND METHOD OF REDUCING EMI BY USE THEREOF

The present invention relates to the art of connectors of the type used to connect a plurality of conductors, such as assembled into a harness, onto a digital device, such as a home computer, video game, calculators, and related high speed digital processing devices capable of radiating electromagnetic waves in a manner inconsistent with EMC and contrary to present or proposed governmental regulations regarding EMI pollution. The invention will be described with particular reference to use as the fixed terminal on a video game; however, it is appreciated that the invention has much broader applications and may be used in various fixed connectors adapted to be positioned on the housing or support wall of devices capable of causing radiated and/or conducted EMI.

BACKGROUND OF INVENTION

Within the last few years, a considerable amount of attention has been directed to electromagnetic interference (EMI) from a wide variety of relatively low power devices, such as home computers, calculators, video games and similar devices. These individual devices create a certain amount of electromagnetic interference which can be quite troublesome when components thereof enter the high frequency range of 1–1,000 Megahertz. Such frequencies are reached in digital devices, such as home computers, video games and calculators, when the signal rate is drastically increased. When rapid signal pulses are employed in processing digital information and in communicating this information, substantial harmonic frequencies are created, especially when relatively square pulses are employed. Radiated and conducted EMI is thus possible by operation of such digital processing equipment. The pollution quotient is magnified by the greatly expanding number of these devices now being clustered. The basic approach to attenuation of the radiation EMI has been to encapsulate or enclose the devices in an electrically conductive shell. Metal housings were first employed for this purpose; however, for various reasons, such as appearance, ease of manufacturing and assembly and safety, digital devices have generally been converted to plastic housings or containments. Such plastic housings provide little or no shielding; therefore, substantial effort has been devoted to the use of coatings on plastic housings to shield interior circuits from radiation of EMI to the surroundings. This attempt to shield the compartment itself is quite expensive and involves metal coatings which may crack or flake. In addition, access openings and doors had to be separately sealed to complete the necessary shielding from radiation by the equipment. To overcome these shielding problems, conductive plastic materials have been developed by compounding conductive particles into the plastic. Such conductive particles such as zinc, copper, nickel, graphite and carbon black have been proposed for compounding with plastic. In addition, certain techniques are known for rendering the plastic itself partially conductive to the extent that it can possibly provide a shielding effect for high frequency radiation from the interior of a digital processing device. Such attempts to shield the device itself from EMI radiation have proven somewhat satisfactory; however, such shielding does not resolve problems created by harnesses interconnecting the device with external appliances such as keyboards and displays. After shielding the device itself, it was found that the harnesses, including a plurality of individual signal conductors or power conductors, could present a certain amount of EMI which will affect the electromagnetic compatibility (EMC) of many devices.

With the mushrooming of sales and the high concentration of personal computers, video games, and related electronic equipment, regulations are being issued to affect the EMI caused by harnesses and other external wiring for digital processing devices. This situation has presented a new round of efforts for rendering consumer products compatible with existing and proposed regulations regarding EMI. The EMI problem exists even though the device itself has circuits designed for reducing conducted and radiated EMI. Also, the problem exists even when adequate shielding is provided for the device. There is still a source of interference created by the interconnecting leads and/or connectors, such as found in harnesses.

It has become common practice ro reduce the EMI from interconnecting harnesses by using the same general concepts employed for reducing the EMI from the device itself. One of the more common approaches has been to provide a shielding sheath around the harness. This sheath must extend the total length of the harness and must be grounded at one or both ends. A shield is not only expensive, but it also provides certain technical difficulties in attempting to shield the total radiated EMI from the many conductors. This also reflects energy into adjacent conductors which can cause coupling difficulties. Coupling problems can be even more pronounced as the frequency increases and the lengths of the conductors in the harness approach approximately half wave length. Such coupling can produce cross talk which is detrimental to the efficient operation of the digital device. In addition, it is necessary to increase the thickness of the shielding layer as the frequency increases.

It has been suggested that each conductor coming into the digital device should be passed through a filter to reduce EMI at the junction of the harness with the housing. This drastically reduces conducted electromagnetic waves. By incorporating a low pass filter, the high frequencies are also dumped by connecting the filter onto a ground plane. Since a single ground plane is employed, each of the conductors passing into the digital device must be individually filtered. This requires a number of filters formed by discrete components, together with the resultant high cost.

Due to mass production requirements, various high volume digital devices, such as electronic games, video games, home computers, and calculators, include a separate structure or connector mounted on the housing of the device. This fixed connector contains a plurality of individual pins extending both into the housing and away from the housing. Internal circuits, harnesses or conductors are joined to these pins. Outside the housing, appropriate conductors or harnesses are terminated by a mass termination connector having individual contacts for each of the conductors within the harness itself. This mass termination connector is placed into the fixed connector on the housing to provide electrical connection to the fixed pins on that housing mounted connector. In this fashion, the housing mounted connector is fixed to the device and provides communication to the internal circuits, as well as communication to the outside appliances, such as displays and keyboards. With the use of these connectors on the housing, efforts have been devoted to provide filtering for each pin. This has been done by connecting each pin to a ground plane by its own capacitor. These decoupling capacitors are generally used in series with a plurality of ferrite beads mounted over individual conductors in the harness and spaced from the housing to provide a certain amount of radiation shielding. The combined beads and individual decoupling capacitors are extremely expensive and can become ineffective since the beads are susceptible to vibration and exposed to external damage.

This concept of using ferrite beads on the individual conductors before they are directed to the housing with individual decoupling capacitors at the intersection with the housing and the harness is the approach now advocated. Such structure uses discrete components and requires extensive assembly costs. Consequently, it is economically unsatisfactory even though it can be used as a part of a multipin connector mounted on the housing itself.

Another approach to solving the problem of EMI radiation and conduction by discrete components on a multipin connector is the use of separate filter pins. These filter pins are constructed from an outer layer of ferrite surrounded by a non-conducting material, such as ceramic. Around the ceramic there is provided a layer of metal. The ceramic layer creates a capacitor. By grounding the outside metal layer to a ground plate, each of the pins is coupled to the ground plate by a capacitance. The ferrite provides an inductive reactance and has a resistive component which rises rapidly to dissipate unwanted high frequencies EMI. The ferrite acts as a series resistance and inductance to concentrate and dissipate EMI. This concept of providing each pin with a separate ferrite sleeve surrounded by a ceramic sleeve and metal sleeve, for capacitor coupling to a ground plane, is extremely expensive. Each filter pin is manufactured by itself and includes its own discrete element. In addition, it is necessary to provide positive and accurate communication of the outer metal sleeve around each pin with the ground plate or plane. For that reason, the multipin connector is generally formed from metal and requires a substantial amount of manufacturing costs. When the terminals or pins of a device are multiplied, such as in video games, the cost of EMI control by individual filter pins is extremely high compared to the relatively low cost of the rest of the device.

In summary, after EMI control by design of the internal circuits and shielding of the housing surrounding the device, there is still a problem with respect to conductors being brought to the device for interconnecting the device with external appliances. When a number of individual conductors must be interconnected with the device, it is desirable to produce a single connector fixedly mounted on the housing or support wall of the device for connection between external harnesses and internal circuits. These connectors are multipin connectors secured to the device for connection with a harness on the outside and circuitboards on the inside. The outside connections still present a certain amount of EMI. Control of this EMI has been attempted by complex shielding, by the use of individual beads and decoupling capacitors for each pin of the connector and by filter pins themselves which create an inductance and capacitance for each individual pin. All of these arrangements have distinct disadvantages; however, they are being used because of the demands resulting from EMI pollution by the tremendous number of radiating devices now coming into the environment.

THE INVENTION

The disadvantages, limitations and conceptual failures regarding reduction or attenuation of electromagnetic interference (EMI) from harnesses and other groups of conductors connected to a digital device of the type operated by signals having frequency components capable of radiating electromagnetic waves above about 5–30 Megahertz have been overcome by the present invention which relates to a modification of the standard multipin connector supported on the digital device and having pins pointing in opposite directions to accept a mass termination connector at the end of a harness at one side of the fixed multipin connector and a connector inside the digital device and connected with the various internal circuits at the other side of the fixed multipin connector. The present invention relates to an improvement in this particular type of fixed connector, which attenuates EMI.

In accordance with the preferred embodiment, EMI attenuation is approximately 5–20 dB of radiated EMI in the general range of 30–200 Megahertz. There is no grounding capacitor or other discrete components or elements for each pin. The header or body of the improved multipin connector can be formed from a non-conductive plastic material, since the fixed multipin connector attached to the digital device does not require connection of the pins in any fashion with a metal ground plane or any other grounding path.

The type of connector to which the invention is directed includes a header or body, as mentioned above, with means for securing the header over an access opening in the supporting wall formed on the housing or other structure of the device being, made compatible (EMC). The header also includes means for fixedly supporting a plurality of interconnecting pins on parallel axes passing through the access opening of the supporting wall or device in a preselected pin layout pattern. These pins are fixed by the header and include first ends pointing away from the access opening and second ends pointing in the opposite direction. The header includes means for electrically isolating each of the pins one from the other. In this type of fixed, multipin connector adapted to be secured onto a digital device or similar source of EMI, the improvement includes a pin encircling member formed of a blend of finely divided particles bonded together in an electrically non-conductive material, this blend of particles includes at least a first material having a high magnetic permeability, low magnetic retentivity, such as standard ferrites, and a second, electrically conductive material. This pin encircling member or energy dissipating mass has a central bore or cavity with an inwardly facing profile generally matching pin pattern, a first end and a second end faced outwardly from the pins of the connector. This connector improvement includes means for fixedly mounting the pin encircling member on the header with the bore or cavity surrounding the pins and the first end of the member spaced from the header in a direction away from the supporting wall a distance greater than the first end of the pins. In this manner, the cavity formed in the pin encircling member extends beyond the outermost ends of the pins fixed in the header.

In the preferred embodiment, this cavity of the pin encircling member forms the receptacle for the harness connector so that the actual interconnecting contacts between the pins fixed on the multipin connector and the harness contacts in its mass terminating connector are well within the confines of the energy absorbing, pin encircling member. By using this type of structure, the radiated EMI from the harness itself is dissipated in the form of heat energy within the material or mass forming the pin encircling member. The high permeability, low retentivity material causes an inductive reaction which induces a voltage differential at various locations within the mass. This differential causes a current flow through the electrically conductive phase of the blended particles in the pin encircling member. Since energy dissipation is a function of $I^2$, the use of conductive particles blended into the pin encircling member allows more efficient dissipation of the energy created by the waves on the harness and connector attempting to expand and collapse. This rapid, efficient energy dissipation at the connector itself prevents creation of EMI from any antenna action or transmission by the harness, even though high frequency data and signals are being transmitted by the conductors connected to the fixed pins in the improved multipin connector. There is no need in this improved connector for a ground plane or plate. Dissipation of energy by the pin encircling member allows a single element on the connector to handle the low energy levels needed to suppress interferences of the type to which the present invention is directed.

Since there is no need to connect the individual fixed pins to a ground plane, the header or body of the connector can be molded from a non-conductive plastic. This reduces the cost of the header and reduces assembly costs involved in junctions or joints between the pins and a ground plate within the connector itself. This is a substantial advance in the art and substantially reduces the overall cost of the fixed multipin connector. This advantage, taken together with the fact that the improved connector attenuates radiated EMI up to at least about 30 dB, illustrates the technological advance obtained by the use of the present invention. In addition, conductive EMI is dissipated without requiring grounded filter circuits for one or more pins in the connector.

To further enhance the EMI attenuation aspect of the novel connector, the pin encircling member has a rearward end adjacent the supporting wall which is a relatively fixed barrier wall that is formed with individual openings for each of the pins. The blended material of the pin encircling member is directly adjacent to the pins and surrounds the pins. Since the blended member is non-conductive, it is possible to bring the material into actual physical engagement with the individual pins. This further enhances the efficiency of conductive EMI attenuation. In addition, this rear barrier wall forms a shield across the access opening to complement and augment any shielding of the digital device done in accordance with standard practice. The use of the barrier wall with apertures for each pin or with very little gaps between the pins and the material forming the encircling member prevents wave formations longitudinally of these pins at the barrier wall. Manufacture of the pin encircling member may require a slight spacing around the pins. This spacing may be filled with electrical insulating material to assure suppression of cross talk and coupling between the pins and through the pin encircling member itself. It is possible to employ a slight amount of conductive material, such as carbon black, in this insulating material to increase the shielding effect at any gap around the pins in the fixed connector.

In accordance with another aspect of the present invention, the header is formed of plastic material and includes a cavity for fixedly receiving the pin encircling member formed from a blended material mentioned above. This construction simplifies the assembly procedure. The header is molded from plastic and the pin encircling member is molded and fired with an outer shape matching a cavity in the plastic header. During assembly, the pin encircling member is snapped into the cavity where it is fixed and held on the header for subsequent attachment to a digital device of the type to which the present invention is directed.

In accordance with still a further aspect of the present invention, the electrically non-conductive material of the pin encircling member is selected from the group consisting of plastic, ceramics and vitreous materials. Preferably, the pin encircling member is a fired ceramic which is electrically non-conductive at least to the extent that it prevents cross talk and mutual coupling between the various pins.

The electrically conductive material in the blend of material forming the pin encircling member may be selected from the group consisting of graphite, carbon black, zinc, copper, nickel and coated glass fibers. The high permeability material is preferably ferrite of the type employed in induction heating and EMI suppression.

The present invention may be defined as the method of reducing EMI radiation from a combination of (a) a harness having a plurality of signal conductors with a length of less than about 2 meters and an end or terminating connector and (b) a multipin intermediate connector over an access opening in a supporting wall of a digital device of the type operated by signals having frequency components capable of radiating electromagnetic waves above about 5–30 Megahertz. This method of reducing EMI comprises fixedly securing a non-conductive mass of magnetically permeable particles onto the intermediate connector and in a position surrounding the pins of the intermediate connector. This method can be further defined as using this same mass fixed on the connector as a shielding member for the access opening over which the connector is attached. Further, by positioning the non-conductive mass of magnetically permeable particles closely adjacent to the pins of the multipin connector, the radiated and conductive electromagnetic fields are intercepted as they attempt to expand and collapse.

The primary object of the present invention is the provision of a multipin connector of the type mounted on the housing or wall of a digital device operated by signals having frequency components capable of radiating EMI, which connector is provided with a fixed energy absorbing member operatively associated with several pins without discrete filtering elements for each pin.

Still a further object of the present invention is the provision of a multipin connector of the type defined above, which connector eliminates the need for a metal ground plate or plane or ground connection for the purpose of suppressing or attenuating EMI.

Still a further object of the present invention is the provision of a multipin connector, as defined above, which connector uses a combined flux concentrating and energy dissipating concept not requiring current dumping or filtering to an adjacent metal plane or plate.

Yet another object of the present invention is the provision of a multipin connector, as defined above, which connector can be manufactured without numerous assembly operations.

Still a further object of the present invention is the provision of a multipin connector, as defined above, which connector has a fixed pin encircling member formed of particles bonded together to dissipate energy at the connector to attenuate EMI.

These and other objects and advantages will become apparent from the following description of the preferred embodiment.

BRIEF DESCRIPTION OF DRAWINGS

In the disclosure, the following figures are employed:

FIG. 6 is a pictorial view of a modification of the preferred embodiment of the invention;

FIG. 7 is a cross sectional view schematically illustrating certain concepts of the present invention;

PREFERRED EMBODIMENT

Figure 1:
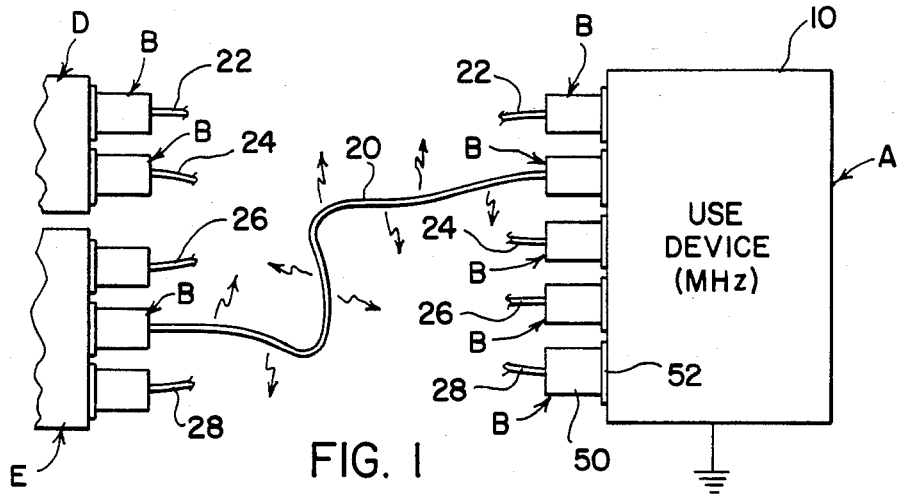
FIG. 1 is a schematic view illustrating the use of the preferred embodiment of the present invention.

Referring now to the drawings, wherein the showings are for the purpose of illustrating a preferred embodiment of the invention only and not for the purpose of limiting same, FIGS. 1–5 show a digital device A such as a microprocessor or the card cage of a video game. This device includes a number of internal circuits operated by signals capable of radiating electromagnetic waves above about 5–30 Megahertz. In accordance with standard practice, a grounded, conductive cabinet 10 surrounds the internal circuits of device A and forms a shielding for these internal circuits to reduce the radiated EMI. To communicate with internal circuits, a number of multipin connectors B are employed. These connectors are constructed in accordance with the present invention and are adapted to be mounted over the cabinet or housing 10 of device A at several spaced access openings, best shown as opening 12 in FIG. 4. In the past, such multipin connectors have been made of metal and provided shielding over the access openings 12. As will be explained later, the preferred embodiment of the present invention may be made from plastic which is non-conductive. Of course, conductive plastic could be employed for connectors B. Multipin connectors B are connected by a plurality of standard harnesses 20–28 with various external appliances, schematically illustrated as display unit D and a keyboard or operating station E. The length of various harnesses, only one of which is shown in its entirety, are relatively small in that they connect juxtapositioned components in a cabinet or other compartment. For that reason, the antenna action for radiated EMI is not substantial. Multipin connectors B, constructed in accordance with the present invention, may be employed at each end of the harness. This is schematically illustrated in FIG. 1 wherein harness 20 is connected onto keyboard or operating station E by a connector B constructed in accordance with the present invention. In a like manner, it is connected to the card cage A by a similar fixed intermediate multipin connector B.

Figure 3:
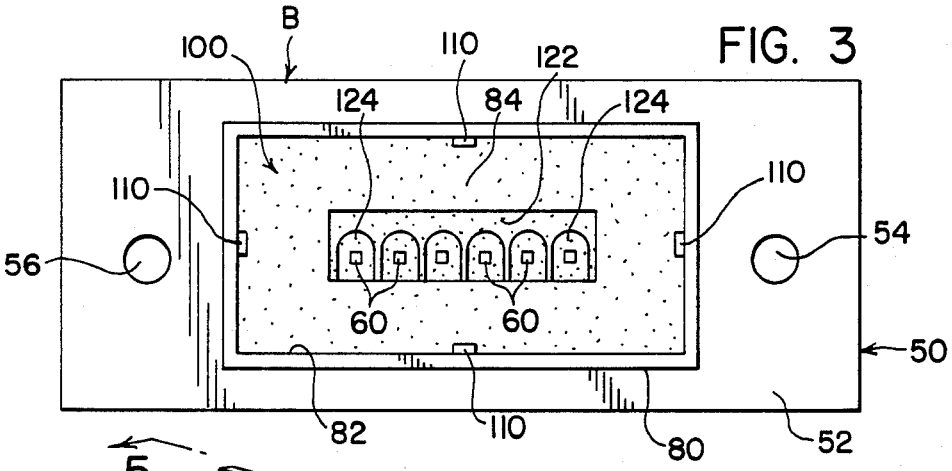
FIG. 3 is a front plan view taken generally along line 3—3 of FIG. 2.
Figure 2:
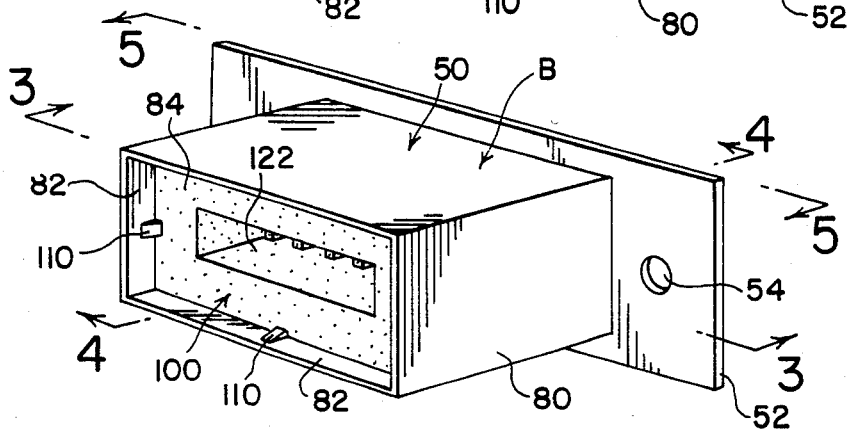
FIG. 2 is a pictorial view of the preferred embodiment of the present invention.
Figure 4:
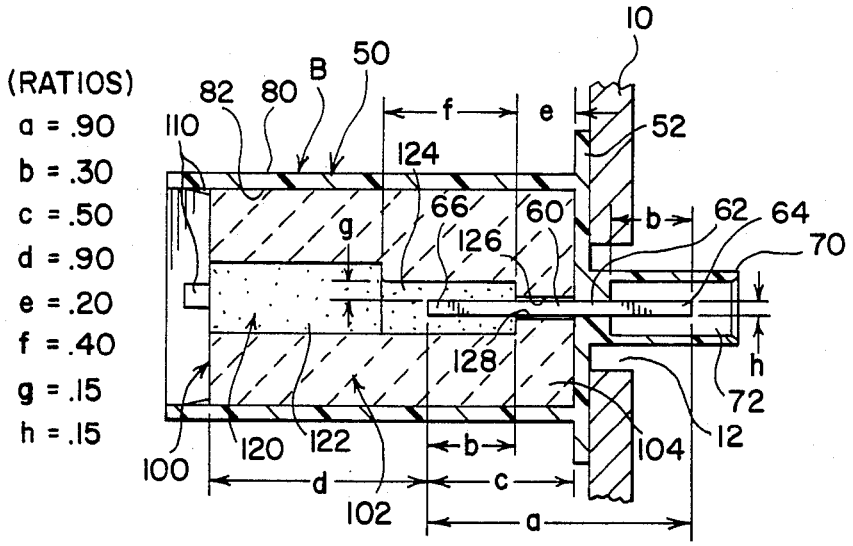
FIG. 4 is a somewhat enlarged cross-sectional view taken generally along line 4—4 of FIG. 2 and including several representative dimensions.
Figure 5:
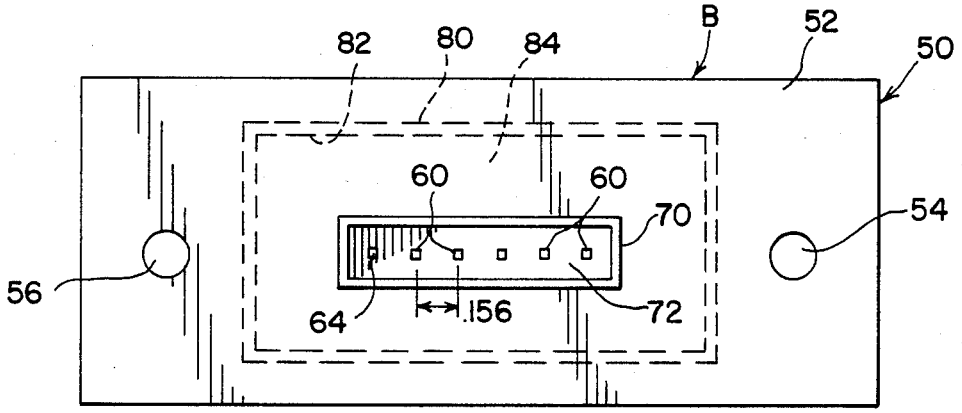
FIG. 5 is a back plan view taken generally along line 5—5 of FIG. 2.
Figure 8:
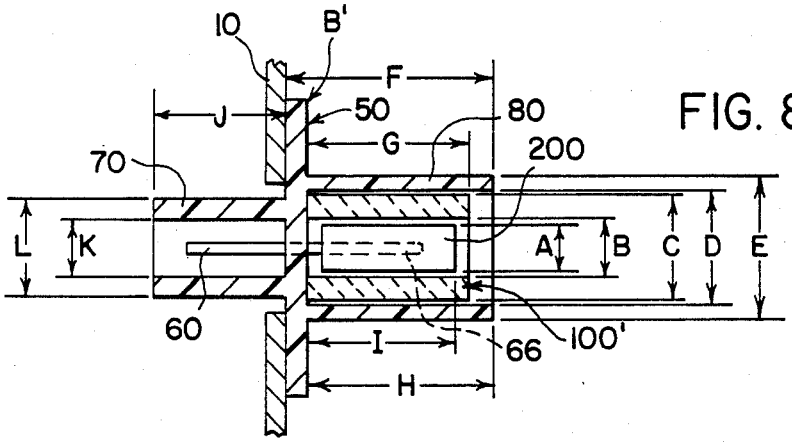
FIGS. 8 and 9 are layout views with representative dimensions for employing the present invention when the multipin connector includes six, twelve, eighteen or twenty-four pins in the connector itself.
Figure 9:
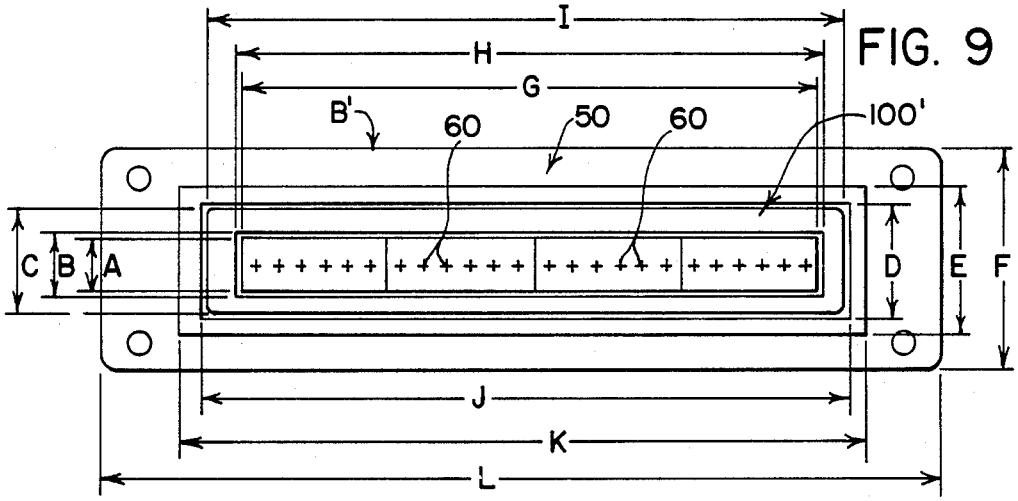

Multipin connectors B are structurally identical except for the number of pins as shown in FIGS. 8 and 9; therefore, only one connector will be described in detail. This description applies to the other connector B. A header 50 molded from a plastic material includes a mounting flange or plate 52 having spaced mounting holes 54, 56. These holes are employed for mounting plate 52 over access opening 12, as best shown in FIG. 4. A plurality of metal pins 60, six of which are shown in FIGS. 1–5, are supported by plastic header 50 in a parallel arrangement with an appropriate spacing between each pin. In the illustrated embodiment, the pins are generally square in cross-section and are mounted on standard 0.156 centers, as shown schematically in FIG. 5. Pins 60, as shown in FIG. 4, include a central portion 62 embedded within the plastic material forming header 50. This exposes inwardly protruding ends 64 and outwardly extending ends 66. These ends are aligned and are adapted to receive mass connectors of the type provided on the end of a harness or on a printed circuitboard. A rear, generally rectangular extension 70 has an internal cavity 72 for receiving an appropriate connector adapted to interconnect circuits within device A with pins 60 of fixed connector B when it is mounted over access opening 12 and onto cabinet or supporting wall 10 of device A. The shape of cavity 72 is selected to provide easy connection of the internal circuits with the fixed, multipin connector B. A forward extension 80 is also rectangular in shape and is molded as an integral part of header 50. Extension 80 is generally rectangular and has an inwardly facing periphery or surface 82 defining a generally rectangular cavity 84, shown best by dashed lines in FIG. 5. Inward periphery 82 matches the outer periphery of an energy absorbing, pin encircling member 100 having a harness connector receiving forward portion 102 and a rear barrier wall 104. A plurality of detents 110 molded around periphery 82 of extension 80 are employed for fixedly securing member 100 into cavity 84 so that composite member 100 can be telescoped into cavity 84 and held in place by detents 110. This is a relatively simple, rapid assembly operation performed after header pins 60 have been molded or embedded within plate 52 of header 50. Pin encircling member 100 is formed of an energy absorbing molded material to be described later. It is advantageous to use member 100 for a shield over access opening 12 and in close proximity with pins 60 to enhance the efficiency of the energy absorption and dissipation. To accomplish these objectives, member 100 has a complex inner cavity 120 with several distinct portions designed to bring the material as close to pins 60 as possible without preventing efficient connection of a harness onto the pins of connector B. Cavity 120, which can be considered a cored inner bore, includes a forward rectangular portion 122 having a dimension generally defined as the difference between dimension d and the sum of dimensions e and f in FIG. 4. This outer rectangular portion is adapted to receive a terminal connector on the end of harness 20. Rectangular cavity portion 122 merges into a cavity portion 124 formed from a plurality of individual channels having domed tops, as best shown in FIG. 3. These channels bring the material of pin encircling member 100 as close as possible to the forward ends 66 of pins 60. In this manner, appropriate contacts on the harness connector extends forward into the individual channels to engage pins 60. This allows member 100 to encircle each of the individual pins at the actual point of electrical contact with terminals or contacts from the harness. Cavity portion 124 is closed by barrier wall 104 having a dimension e, as shown in FIG. 4, and into which are provided a plurality of openings 126 surrounding the individual pins 60. These openings 126 may be larger than pins 60. In this instance, spaces 128 can be filled with insulating material or with a gasket material that helps shield the inside of device A. As explained in the introductory portion, pin encircling member 100 is formed from a material that is not electrically conductive. It does have at least an internal core which is sufficiently conductive to provide a shielding effect over access opening 12 at each individual pin connector. Of course, a slightly conductive plastic could be employed for header 50 to provide a shielding effect. Member 100 is used to absorb radiated EMI and has a dual function of shielding opening 12 from radiation.

Figure 10:
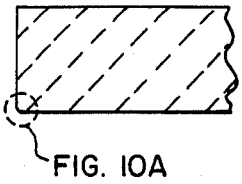
FIG. 10 is a partial enlarged view showing a portion of the mass forming the pin encircling member used in the preferred embodiment of the present invention; and, FIGS. 10A, 10B are enlarged portions of the mass shown in FIG. 10 with two separate preferred encapsulating processes illustrated somewhat schematically.
Figure 10A:
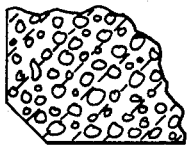
Figure 10B:
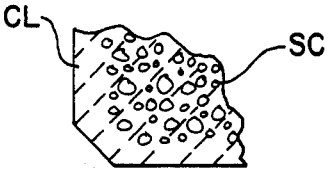

Energy absorbing, pin encircling member 100 is formed from a composite material having a surface isolation property caused by low electrical conductivity, such as less than about 5 Ohm cm and an internal core with high magnetic permeability, low retentivity and at least semi-conductivity. Such material can be a fired ceramic encapsulating a blend of EMI absorbent materials. A blend of high magnetically permeable powder and electrically conductive particles held or bound together with an electrically non-conductive binder, such as ceramic can be manufactured by using powdered metallurgy technology wherein the powders and/or particles are blended together with a ceramic frit and molded into the desired shape under high pressure. Thereafter, the green blank is fired to a temperature sufficient to melt the frit and form the blank into a rigid structure. Such a member is shown in FIGS. 10, 10A. It is possible to form the high permeability particles or powder and conductive powder or particles into a self-supporting core SC as shown in FIG. 10B. This core is then encapsulated by a ceramic layer CL or by another non-conductive shape supporting material, such as an epoxy resin. It is also possible to blend high permeability material with a conductive material and mold the blend together with a high packing factor by an electrically non-conductive binder, such as various thermal setting or thermal plastic resins, ceramic material or vitreous substances. The high packing factor facilitates particle-to-particle conduction by interface engagement; however, this renders member 100 somewhat rigid and decreases its moldability. The high permeability particles are standard ferrite particles. Of course, nickel particles could be used. In that situation, the nickel particles, if packed closely, would assist in the electrical conductivity of core SC. Preferably, graphite or carbon black particles are used for the interparticle and intra-particle conductivity; however, particles of zinc, copper, nickel, coated glass fibers and similar conductive fillers can be employed. Such conductive phase of the homogeneous material forming the energy absorbing and dissipating, pin encircling member 100 can also be formed from a mixture of conductive particles, such as nickel and graphite as has been suggested to make plastic conductive for EMI shielding of a digital device.

Composing the energy dissipating member 100 from a blend of high permeability particles and conductivity inducing particles, as a core material, surrounded by an electrically non-conductive case or blended into and bonded homogeneously by an electrically non-conductive matrix has certain properties allowing economical use of member 100 in a fixed multipin connector of the type used in video games, home computers, and other digital apparatus susceptible to EMI radiation.

By being electrically non-conductive, the EMI suppression member 100 does not form an electrical path to any surrounding metal structures. This allows use of the material or mass of member 100 close to, if not actually touching, signal and/or power pins 60 without conductive or coupled cross-talk between these pins. By reducing any spacing requirements between the pins and the suppressor or energy dissipating member, the core material can perform more efficiently since dissipation and/or absorption efficiency is related to the distance between the core particles and the emitting source, i.e. the pins 60 and associated contacts. Since member 100 operates on a combined induced voltage and resistive energy dissipation, the ability to mount the member on, or closely spaced from, pins 60 of the multipin connector B increases the induced voltage at the individual magnetically permeable particles and, thus, the resultant current flow in member 100, so that the $I^2R$ energy dissipation is magnified.

Since multipin connector B employing member 100 does not employ filtering or shielding, the member can be electrically isolated from the chassis ground or any other ground plane and need not surround the total length of incoming cables of harness 22 or a connector at the end of the harness. The theory of EMI suppression at a multipin connector assumes a length of harness 20 of less than $\frac{1}{2}$ wave length, which for EMI approaching 100 MHz is about 1.5 meters. The sleeve is then about 1.0 inches long and dampens radiated EMI and conductive EMI by absorption. Expanding and collapsing flux fields are concentrated by the high permeability core material and create induced voltage differentials which cause current flow through both the high permeability and conductive particles. By reducing the effective resistivity on the mass in member 100 by a high packing factor for the particle blend in the core of the member, circulating currents are increased and energy is efficiently dissipated. This inhibits creation of radiation waves on the conductors spaced from the fixed connector due to the absorption efficiency enhanced by both geometrical concepts (shape of cavity 120) and functional dissipation vehicles (closeness of barrier wall 104 to pins 60). The need for cable shielding and/or filtering is eliminated for the consumer type electronic equipment now being charged as the major contributor to EMI pollution. Pin encircling member 100 is now formed from a material sold under the trademark CHOSORB by Chomerics, Inc. 77 Dragon Court, Woburn, Mass.

Referring more particularly to FIG. 4, a representative size for energy dissipating, pin encircling member 100 is set forth for a six pin connector B. In FIGS. 8 and 9, representative dimensions are listed for utilizing a rectangular pin encircling member 100' surrounding ends 66 of pins 60 in plastic header 50. Such a device is shown in FIG. 6. In these illustrations, connector 200 is adapted to be connected onto the end of harness 20. The terminal connector 200 joins harness 20 with the pins 60 of multipin connector B'. Pin encircling connector B' can be manufactured in a six, twelve, eighteen or twenty-four pin version with the pins 60 being on centers of 0.156 inches. The dimensions in the charts associated with FIGS. 8 and 9 are representative of the general dimensions envisioned for the use of a pin encircling member on a multipin connector of the type to be used in the environment to which the present invention is directed. FIG. 6 is a schematic representation of a rectangular pin encircling member 100' as contemplated for a six pin version of the schematically illustrated multipin connectors shown in FIGS. 8 and 9.

Referring now to FIG. 7, the use of a pin encircling, energy abosrbing member R for a single conductor 302 is illustrated. In this situation, cylindrical ring R is fixedly secured onto a non-conducting support 300 having an opening 301 through which conductor 302 extends. A connection or joint 304 interconnects conductor 302 with a separate conductor 305 on the other side of access opening 12 in wall 10. Support member 300 has a rearward boss 306 for supporting joint 304. A single conductor is encircled by a member or ring R fixedly mounted on a non-conductive support 300. The outer dimension of ring R is greater than the internal dimension of access opening 12 for creating both a shielding effect for the access opening and also an energy absorbing, energy dissipating action between conductor 302 and the material forming encircling member or ring R.

I claim:

1. In a multipin connector to be fixedly mounted over a conductor access opening in a supporting wall of a digital device of the type operated by signals having frequency components capable of radiating electromagnetic waves above about 5–30 Megahertz, said connector comprising a header having a header wall with means for securing said header wall over said opening and on said supporting wall, means for fixedly supporting a plurality of conductor interconnecting pins on parallel axes passing through said access opening in a preselected pin layout pattern with said pins having first ends pointing away from said wall and second ends pointing in the direction opposite to said first ends, and means on said header for electrically isolating said pins one from the other, the improvement comprising: a pin encircling member formed of a blend of finely divided particles surrounded by an electrical non-conductive material, said blend of particles including at least a first material having a high magnetic permeability, low magnetic retentivity and a second, electrically conductive material, said encircling member having a central bore with an inwardly facing profile generally matching said pin pattern, a first end portion, and a second end portion surrounding said pins a selected distance therefrom; and means for fixedly mounting said pin encircling member of said header with said inwardly facing profile of said bore surrounding said pins and said first end portion spaced away from said header wall a distance greater than said first ends of said pins.

2. The improvement as defined in claim 1 wherein said second end portion of said pin encircling member includes a barrier wall with apertures for each of said pins and having an outer dimension larger than said access opening over which said connector is to be fixedly mounted.

3. The improvement as defined in claim 2 wherein said apertures are slightly larger than said pins whereby spaces are defined between said pins and said barrier wall of said pin encircling member.

4. The improvement as defined in claim 3 including an electrical insulating material in said spaces.

5. The improvement as defined in claim 4 wherein said header is formed from a plastic, electrically non-conductive material.

6. The improvement as defined in claim 5 wherein said header includes a cavity for fixedly receiving-said pin encircling member.

7. The improvement as defined in claim 6 including detent means for fixedly securing said pin encircling member into said cavity of said header.

8. The improvement as defined in claim 1 wherein said header is formed from a plastic, electrically non-conductive material.

9. The improvement as defined in claim 8 wherein said second end portion of said pin encircling member includes a barrier wall with apertures for each of said pins and having an outer dimension larger than said access opening over which said connector is to be fixedly mounted.

10. The improvement as defined in claim 1 wherein said header includes a cavity for fixedly receiving said pin encircling member.

11. The improvement as defined in claim 10 wherein said second end of said pin encircling member includes a barrier wall with apertures for each of said pins and having an outer dimension larger than said access opening over which said connector is to be fixedly mounted.

12. The improvement as defined in claim 10 wherein said header is formed from a plastic, electrically non-conductive material.

13. The improvement as defined in claim 10 including detent means for fixedly securing said pin encircling member into said cavity of said header.

14. The improvement as defined in claim 11 including detent means for fixedly securing said pin encircling member into said cavity of said header.

15. The improvement as defined in claim 12 including detent means for fixedly securing said pin encircling member into said cavity of said header.

16. The improvement as defined in claim 1 wherein said central bore of said pin encircling member includes a connector receptacle means for receiving a multiconductor connector having contacts matching said pins fixed on said header.

17. The improvement as defined in claim 16 wherein said second end of said pin encircling member includes a barrier wall with apertures for each of said pins and having an outer dimension larger than said access opening over which said connector is to be fixedly mounted.

18. The improvement as defined in claim 16 wherein said header includes a cavity for fixedly receiving said pin encircling member.

19. The improvement as defined in claim 16 wherein said header is formed from a plastic, electrically non-conductive material.

20. The improvement as defined in claim 1 wherein said electrically non-conductive material is selected from the group consisting of plastic, ceramics and vitreous materials.

21. The improvement as defined in claim 1 wherein said first material is ferrite.

22. The improvement as defined in claim 1 wherein said electrically conductive material is selected from the group consisting of graphite, carbon black, zinc, copper, nickel, and coated glass fibers.

23. The improvement as defined in claim 1 wherein said blend of finely divided particles is formed into a core and said electrically non-conductive material is a barrier formed around said core.

24. In a multipin connector to be fixedly mounted over a conductor access opening in a supporting wall of a digital device of the type operated by signals having frequency components capable of radiating electromagnetic waves above about 5–30 Megahertz, said connector comprising a header having a header wall with means for securing said header wall over said opening and on said supporting wall, means for fixedly supporting a plurality of conductor interconnecting pins on parallel axes passing through said access opening in a preselected pin layout pattern with said pins having first ends pointing away from said wall and second ends pointing in the direction opposite to said first ends, and means on said header for electrically isolating said pins from the other, the improvement comprising: a pin encircling member formed of a blend of finely devided particles bonded together in an electrically non-conductive material, said blend of particles including at least one material having a high magnetic permeability, low magnetic retentivity, said encircling member having a central bore with an inwardly facing profile generally matching said pin pattern, a first end portion and a second end portion surrounding said pins a selected distance therefrom; and means for fixedly mounting said encircling member on said header with said inwardly facing profile of said bore surrounding said pins and said first end portion spaced from said header wall a distance greater than said first ends of said pins, said second end portion of said pin encircling member including a barrier wall with apertures for each of said pins and having an outer dimension larger than said access opening over which said connector is to be mounted.

25. The improvement as defined in claim 24 wherein said apertures are slightly larger than said pins whereby spaces are defined between said pins and said barrier wall of said pin encircling member.

26. The improvment as defined in claim 24 wherein said header is formed from a plastic, electrically non-conductive material.

27. The improvement as defined in claim 24 wherein said header includes a cavity for fixedly receiving said pin encircling member.

28. The improvement as defined in claim 27 including detent means for fixedly securing said pin encircling member into said cavity of said header.

29. The improvement as defined in claim 24 wherein said central bore of said pin encircling member includes a connector receptacle means for receiving a multiconductor connector having contacts matching said pins fixed on said header.

30. The improvement as defined in claim 24 wherein said blend of finely divided particles is formed into a core and said electrically non-conductive material is a barrier formed around said core.

31. In a multipin connector to be fixedly mounted over a conductor access opening in a supporting wall of a digital device of the type operated by signals having frequency components capable of radiating electromagnetic waves above about 5–30 Megahertz, said connector comprising a header having a header wall with means for securing said header wall over said opening and on said supporting wall, means for fixedly supporting a plurality of conductor interconnecting pins on parallel axes passing through said access opening in a preselected pin layout pattern with said pins having first ends pointing away from said wall and second ends pointing in the direction opposite to said first ends, and means on said header for electrically isolating said pins one from the other, the improvement comprising: a pin encircling member formed of a blend of finely divided particles bonded together in a matrix material, said blend of particles including at least one material having a high magnetic permeability, low magnetic retentivity, said encircling member having a central bore with an inwardly facing profile generally matching said pin pattern, a first end portion, and a second end portion surrounding said pins a selected distance thereform; and means for fixedly mounting said encircling member on said header with said inwardly facing profile of said bore surrounding said pins and said first end portion spaced from said header wall in a direction away from said supporting wall a distance greater than said first ends of said pins, and said header being formed from a non-conductive plastic material.

32. The improvement as defined in claim 31 wherein said header includes a cavity for fixedly receiving said pin encircling member.

33. The improvement as defined in claim 32 including detent means for fixedly securing said pin encircling member into said cavity of said header.

34. The improvement as defined in claim 31 wherein said central bore of said pin encircling member includes a connector receptacle means for receiving a multiconductor connector having contacts matching said pins fixed on said header.

35. A method of reducing EMI radiation from a combination of (a) a multiconductor harness having a plurality of signal conductors with a length of less than about 2 meters and a terminating connector and (b) a multipin intermediate connector over an access opening in a supporting wall of a digital device of the type operated by signals having frequency components capable of radiating electromagnetic waves about 5–30 Megahertz, said method comprising: fixedly securing a non-conductive mass, including at least particles having a high magnetic permeability and low magnetic retentivity, onto said intermediate connection thereby surrounding said pins of intermediate connector at said wall.

36. A method of reducing EMI radiation, as defined in claim 35, further including using said mass as a shielding member over said access opening.

37. A method of reducing EMI radiation, as defined in claim 36, further including positioning said mass closely adjacent to said pins of said multipin connector thereby intercepting radiated and conductive electromagnetic fields as they are expanding and collapsing.

38. A method of reducing EMI radiation from a combination of (a) a multiconductor harness having a plurality of signal conductors with a length of less than about 2 meters and a terminating connector and (b) a multipin intermediate connector over an access opening in a supporting wall of a digital device of the type operated by signals having frequency components capable of radiating electromagnetic waves above about 5–30 Megahertz, said method comprising: forming said intermediate connector from a non-conductive plastic and fixedly mounting onto said plastic a non-conductive member with a homogeneously dispersed blend of particles some of which concentrate electromagnetic fields to create induced voltage differentials as said fields expand and collapse and the other particles of which provide electrically conductive circuits for dissipation of the energy in said concentrated fields.

39. In a multipin connector to be fixedly mounted over a conductor access opening in a supporting wall of a digital device of the type operated by signals having frequency components capable of radiating EMI, said connector comprising a header with means for securing said header over said opening and on said supporting wall, means for fixedly supporting a plurality of conductor interconnecting pins on parallel axes passing through said access opening in a preselected pin layout pattern and means on said header for electrically isolating said pins one from the other, the improvement comprising: a pin encircling member formed of a blend of finely divided particles bonded together in a generally low electrically conductive material, said blend of particles including at least a first material having a high magnetic permeability, low magnetic retentivity; and, means for fixedly mounting said pin encircling member on said header and in a position surrounding said pins whereby said member is operatively associated with each of said pins.

40. A method of reducing EMI from a cluster of conductors having a terminating connector coupled onto the several pins of a fixed interconnecting connector mounted on a digital device of the type operated by signals having frequency components capable of radiating EMI, said method comprises: fixedly positioning onto said fixed interconnecting connector and in a pattern surrounding and operatively associated with each of said several pins a mass of electrically non-conductive material capable of dissipating electromagnetically transmitted energy.

41. In a connector to be fixedly mounted over a conductor access opening in a supporting wall of a digital device of the type operated by signals having frequency components capable of radiating electromagnetic waves about 5–30 Megahertz, said connector comprising a header having a header wall with means for securing said header wall over said opening and on said supporting wall, means for fixedly supporting a conductor interconnecting pin passing through said access opening with said pin having a first end pointing away from said wall and a second end pointing in the direction opposite to said first end, and means on said header for electrically isolating said pin from said wall, the improvement comprising: a pin encircling member formed of a blend of finely divided particles bonded together in an electrically non-conductive material, said encircling member having a central bore with an inwardly facing profile generally matching said pin, a first end portion, and a second end portion surrounding said pin a selected distance; and means for fixedly mounting said pin encircling member of said header with said inwardly facing profile of said bore surrounding said pin and said first end portion spaced from said header wall in a direction away from said supporting wall a distance greater than said first end of said pin.

42. In a multipin connector to be fixedly mounted over a conductor access opening in a supporting wall of a digital device of the type operated by signals having frequency components capable of radiating electromagnetic waves about 5–30 Megahertz, said connector comprising a header with means for securing said header over said opening and on said supporting wall, means for fixedly supporting a plurality of conductor interconnecting pins on parallel axes passing through said access opening in a preselected pin layout pattern with said pins having first end pointing away from said wall and second ends pointing in the direction opposite to said first ends, and means on said header for electrically isolating said pins one from the other, the connector further comprising:.means on said header for selectively receiving and securing a pin encircling member and a matching pin encircling member formed of an EMI energy dissipating material and having a central bore with an inwardly facing profile generally matching said pin pattern.

43. The improvement as defined in claim 42 wherein said header is formed from a plastic, electrically non-conductive material.

* * * * *